US009120598B2

(12) United States Patent
Meyers et al.

(10) Patent No.: US 9,120,598 B2
(45) Date of Patent: Sep. 1, 2015

(54) STACKABLE CONTAINER SYSTEM

(75) Inventors: David O. Meyers, Kaysville, UT (US); Steven M. Sorensen, Alpine, UT (US)

(73) Assignee: RUNWAY BLUE, LLC, Alpine, UT (US)

( * ) Notice: Subject to any disclaimer, the term of this patent is extended or adjusted under 35 U.S.C. 154(b) by 0 days.

(21) Appl. No.: 13/609,238

(22) Filed: Sep. 10, 2012

(65) Prior Publication Data

US 2014/0069917 A1 Mar. 13, 2014

(51) Int. Cl.
*B65D 21/02* (2006.01)
*B65D 51/24* (2006.01)

(52) U.S. Cl.
CPC ..... *B65D 21/022* (2013.01); *B65D 51/242* (2013.01)

(58) Field of Classification Search
USPC ..... 220/4.26, 4.27, 23.6, 293, 592.01, 757, 220/758, 759, 212.5, 254.1, 254.8, 756, 220/760; 206/503, 508; 294/27.1, 33
See application file for complete search history.

(56) References Cited

U.S. PATENT DOCUMENTS

| | | | | |
|---|---|---|---|---|
| 1,037,051 | A | 8/1912 | Ramsey | |
| 1,094,469 | A | 4/1914 | Pick | |
| 1,389,732 | A | 9/1921 | Baron | |
| 1,479,053 | A | 1/1924 | Brooks | |
| 1,573,620 | A * | 2/1926 | Allston | 206/541 |
| 2,026,701 | A * | 1/1936 | Pearl | 210/245 |
| 2,056,879 | A | 10/1936 | Winterhalter et al. | |
| 2,272,867 | A | 2/1942 | Cobel | |
| 2,514,573 | A | 7/1950 | Harrison | |
| 2,573,378 | A | 10/1951 | Zurlinden | |
| 2,574,876 | A | 11/1951 | Lebus | |
| 2,575,299 | A * | 11/1951 | Scheel | 126/261 |
| 2,638,253 | A | 5/1953 | Mueller | |
| 2,748,997 | A | 6/1956 | Richmond, Sr. | |
| 2,752,971 | A | 7/1956 | Tupper | |
| 2,754,866 | A | 7/1956 | Coltman | |
| 3,022,925 | A | 2/1962 | Daniell | |
| 3,091,361 | A * | 5/1963 | Gawron | 206/508 |

(Continued)

FOREIGN PATENT DOCUMENTS

| | | |
|---|---|---|
| CN | 201139196 | 10/2008 |
| JP | 2006103793 A | 4/2004 |
| JP | 2008247404 | 10/2008 |

OTHER PUBLICATIONS

U.S. Appl. No. 12/762,292, filed Apr. 16, 2010, Meyers, et al.

(Continued)

*Primary Examiner* — Fenn Mathew
*Assistant Examiner* — Madison L Poos
(74) *Attorney, Agent, or Firm* — Maschoff Brennan

(57) ABSTRACT

The present invention is directed to a stackable container system that includes containers and lids that are configured to allow any of the lids to be used on any of the containers. The bottom of each container interlocks with the top of each lid to allow the containers to be stacked. A handle may also be included that is configured to attach to any of the lids to form a handle for carrying a stack of the interlocked containers. The stackable container system may also include a storage container, such as a beverage bottle, for storing a stack of interlocked containers. Accordingly, each container can be used to store ingredients that are to be later combined in the storage container for consumption. The lids can be configured to be heated or cooled to provide heating or cooling to contents of the container or to the storage container in general.

20 Claims, 10 Drawing Sheets

(56) References Cited

U.S. PATENT DOCUMENTS

| | | | | |
|---|---|---|---|---|
| 3,143,205 | A | 8/1964 | Ruderian | |
| 3,144,016 | A * | 8/1964 | Basci | 126/265 |
| 3,168,226 | A | 2/1965 | Underwood | |
| 3,369,691 | A * | 2/1968 | Wei | 220/4.27 |
| 3,552,548 | A | 1/1971 | Wallestad et al. | |
| 3,770,160 | A | 11/1973 | Flider | |
| 3,820,692 | A | 6/1974 | Swett et al. | |
| D233,116 | S | 10/1974 | Swett et al. | |
| 4,022,352 | A | 5/1977 | Pehr | |
| 4,136,799 | A | 1/1979 | Albert | |
| 4,158,902 | A | 6/1979 | Chernack et al. | |
| 4,170,302 | A * | 10/1979 | Baca | 206/545 |
| D261,088 | S | 10/1981 | Akimov et al. | |
| 4,399,926 | A | 8/1983 | Eidels-Dubovoy | |
| 4,457,458 | A | 7/1984 | Heinol | |
| 4,474,303 | A | 10/1984 | Maccise | |
| 4,519,518 | A | 5/1985 | Wiles et al. | |
| 4,537,044 | A | 8/1985 | Putnam | |
| 4,735,333 | A | 4/1988 | Lay et al. | |
| 4,776,501 | A | 10/1988 | Ostrowsky | |
| 4,805,790 | A | 2/1989 | Leonetti et al. | |
| 4,932,225 | A | 6/1990 | Bighouse | |
| 5,065,877 | A | 11/1991 | Karppinen et al. | |
| 5,065,911 | A | 11/1991 | Rohr et al. | |
| 5,088,614 | A | 2/1992 | Dumestre | |
| D330,862 | S | 11/1992 | Shibley et al. | |
| 5,228,584 | A | 7/1993 | Williams, Jr. | |
| D342,898 | S | 1/1994 | Baschmackoff | |
| 5,289,930 | A | 3/1994 | Inouye | |
| D350,460 | S | 9/1994 | Picozza et al. | |
| 5,386,922 | A | 2/1995 | Jordan | |
| D356,499 | S | 3/1995 | Cautereels et al. | |
| 5,547,111 | A | 8/1996 | Geiger et al. | |
| 5,609,277 | A | 3/1997 | McDonald | |
| D382,968 | S | 8/1997 | Giles et al. | |
| D404,305 | S | 1/1999 | De Baschmakoff | |
| D405,654 | S | 2/1999 | Moran | |
| D421,547 | S | 3/2000 | Demers | |
| 6,161,713 | A | 12/2000 | Krich | |
| 6,283,333 | B1 | 9/2001 | Knickerbocker et al. | |
| 6,299,005 | B1 | 10/2001 | Higgins | |
| 6,379,032 | B1 | 4/2002 | Sorensen | |
| D458,081 | S | 6/2002 | Bodum | |
| D461,420 | S | 8/2002 | Kerman | |
| D497,431 | S | 10/2004 | Bentley | |
| 6,832,412 | B2 | 12/2004 | Kim | |
| 6,860,397 | B1 | 3/2005 | Walters, Jr. | |
| D504,273 | S | 4/2005 | Ancona | |
| D508,185 | S | 8/2005 | Gauss | |
| D510,235 | S | 10/2005 | Sorensen | |
| D518,336 | S | 4/2006 | Hirani | |
| 7,073,678 | B1 | 7/2006 | Dibdin et al. | |
| D526,827 | S | 8/2006 | Allen et al. | |
| D528,862 | S | 9/2006 | Li | |
| D529,339 | S | 10/2006 | Carreno et al. | |
| D532,650 | S | 11/2006 | de Groote | |
| D543,454 | S | 5/2007 | Leoncavallo et al. | |
| D546,131 | S | 7/2007 | Morales | |
| D547,607 | S | 7/2007 | Forsman | |
| D565,353 | S | 4/2008 | Roth et al. | |
| D574,190 | S | 8/2008 | Homma | |
| D580,227 | S | 11/2008 | Roth et al. | |
| D586,184 | S | 2/2009 | Miller et al. | |
| D587,069 | S | 2/2009 | Bodum | |
| D589,751 | S | 4/2009 | Liu et al. | |
| D592,913 | S | 5/2009 | Pinelli et al. | |
| 7,533,783 | B2 | 5/2009 | Choi et al. | |
| D593,811 | S | 6/2009 | Carreno | |
| D599,664 | S | 9/2009 | Fujinami et al. | |
| D604,103 | S | 11/2009 | Alviar et al. | |
| D609,970 | S | 2/2010 | Richau et al. | |
| D613,110 | S | 4/2010 | Lane et al. | |
| D622,089 | S | 8/2010 | Daniel et al. | |
| D622,554 | S | 8/2010 | Carreno | |
| 7,806,284 | B2 | 10/2010 | Mangano | |
| D626,837 | S | 11/2010 | Meyers et al. | |
| D626,838 | S | 11/2010 | Meyers et al. | |
| D628,483 | S | 12/2010 | McKinney et al. | |
| D629,657 | S | 12/2010 | Carreno | |
| 7,870,980 | B2 | 1/2011 | Wilson et al. | |
| D641,594 | S | 7/2011 | Huang | |
| D644,065 | S | 8/2011 | Llerena | |
| 8,020,257 | B2 | 9/2011 | Merten et al. | |
| D646,546 | S | 10/2011 | Robinson et al. | |
| D646,919 | S | 10/2011 | Nilsson | |
| D647,760 | S | 11/2011 | Pearson | |
| D652,256 | S | 1/2012 | Eyal | |
| D655,131 | S | 3/2012 | Nilsson | |
| D655,967 | S | 3/2012 | Bodum | |
| D656,357 | S | 3/2012 | Enghard | |
| D661,551 | S | 6/2012 | Gilbert | |
| D666,047 | S | 8/2012 | Lin | |
| D666,061 | S | 8/2012 | Ying | |
| D667,694 | S | 9/2012 | Meyers et al. | |
| 8,302,796 | B1 | 11/2012 | Johnson | |
| 8,342,349 | B2 * | 1/2013 | Lu | 220/23.86 |
| D677,121 | S | 3/2013 | Meyers et al. | |
| D686,885 | S | 7/2013 | Meyers et al. | |
| D686,886 | S | 7/2013 | Meyers et al. | |
| D686,887 | S | 7/2013 | Meyers et al. | |
| D686,888 | S | 7/2013 | Meyers et al. | |
| 2002/0074334 | A1 | 6/2002 | Karp | |
| 2003/0085228 | A1 | 5/2003 | Oakes | |
| 2004/0217139 | A1 | 11/2004 | Roth et al. | |
| 2004/0262306 | A1 | 12/2004 | Smith | |
| 2005/0045634 | A1 | 3/2005 | Ward et al. | |
| 2005/0045636 | A1 | 3/2005 | Lown et al. | |
| 2005/0205577 | A1 * | 9/2005 | Park | 220/367.1 |
| 2007/0012693 | A1 * | 1/2007 | Kummer | 220/4.27 |
| 2007/0175931 | A1 | 8/2007 | Leoncavallo et al. | |
| 2008/0099514 | A1 | 5/2008 | Carter et al. | |
| 2009/0178940 | A1 | 7/2009 | Said | |
| 2009/0188884 | A1 | 7/2009 | Nelson et al. | |
| 2009/0188933 | A1 | 7/2009 | Daams | |
| 2009/0301990 | A1 | 12/2009 | Cresswell et al. | |
| 2010/0200438 | A1 | 8/2010 | Davies | |
| 2010/0206835 | A1 | 8/2010 | Yu | |
| 2010/0224631 | A1 | 9/2010 | Roth et al. | |
| 2010/0282703 | A1 | 11/2010 | Yang | |
| 2011/0017760 | A1 | 1/2011 | Newman | |
| 2011/0253733 | A1 | 10/2011 | Meyers et al. | |

OTHER PUBLICATIONS

U.S. Appl. No. 13/232,891, filed Sep. 14, 2011, Meyers, et al.
U.S. Appl. No. 13/232,935, filed Sep. 14, 2011, Meyers, et al.
U.S. Appl. No. 29/430,882, filed Aug. 30, 2012, Meyers, et al.
U.S. Appl. No. 29/431,544, filed Sep. 7, 2012, Meyers, et al.
U.S. Appl. No. 13/610,445, filed Sep. 11, 2012, Meyers, et al.
U.S. Appl. No. 13/633,864, filed Oct. 2, 2012, Meyers, et al.
U.S. Appl. No. 29/457,097, filed Jun. 6, 2013, Sorensen, et al.
U.S. Appl. No. 29/457,096, filed Jun. 6, 2013, Sorensen, et al.
U.S. Appl. No. 61/832,085, filed Jun. 6, 2013, Sorensen, et al.
Kor One, http://www.korwater.com/buyONE, accessed Apr. 21, 2010.
Core 77, http://www.core77.com/blog/materials/kor.sub.--one.sub.--water.su-b.--vessel.sub--actual.sub.--size.sub.--10211.asp, accessed Apr. 21, 2010.
Koyono, http://www.koyono.com/KOR-ONE-Green-Zen-Water-Hydration-Vessel.sub- .--p/kor-one.htm, accessed Apr. 21, 2010.
Fit Sugar, www.fitsugar.com/2496788, accessed Apr. 21, 2010.
Thermos, http://www.shopthermos.com/detail/TMS+HP4000GR6, accessed Apr. 21, 2010.
Goodlifter, http://www.goodlifer.com/2009/02/360-paper-water-bottle/, accessed Apr. 21, 2010.
Notice of Allowance from U.S. Appl. No. 29/430,882 dated Aug. 5, 2013.
Advisory Action from U.S. Appl. No. 12/762,292 dated May 24, 2013.
Office Action from U.S. Appl. No. 12/762,292 dated Jul. 1, 2013.
Office Action from U.S. Appl. No. 12/762,292 dated Oct. 2, 2012.
Office Action from U.S. Appl. No. 12/762,292 dated Jul. 17, 2012.

(56) References Cited

OTHER PUBLICATIONS

Office Action from U.S. Appl. No. 12/762,292 dated Feb. 10, 2012.
Notice of Allowance from U.S. Appl. No. 29/431,544 dated Aug. 14, 2013.
Office Action from U.S. Appl. No. 29/431,544 dated Mar. 25, 2013.
Office Action from U.S. Appl. No. 13/610,445 dated Mar. 29, 2013.
Office Action from U.S. Appl. No. 13/633,864 dated Mar. 29, 2013.
Office Action from U.S. Appl. No. 13/232,891 dated Jul. 19, 2013.
International Search Report from PCT Application No. PCT/US2011/026508 dated Sep. 29, 2011.
Written Opinion from PCT Application No. PCT/US2011/026508 dated Sep. 29, 2011.
International Preliminary Report on Patentability from PCT Application No. PCT/US2011/026508 dated Oct. 16, 2012.
International Search Report from PCT Application No. PCT/US2012/054483 dated Nov. 16, 2012.
International Search Report and Written Opinion from PCT Application No. PCT/US2012/054497 dated Nov. 20, 2012.
International Search Report and Written Opinion from PCT Application No. PCT/2013/052132 dated Aug. 16, 2013.
International Preliminary Report on Patentability from PCT/US2013/020868, dated Mar. 19, 2015.

* cited by examiner

STACKABLE CONTAINER SYSTEM

CROSS-REFERENCE TO RELATED APPLICATIONS

Not Applicable.

BACKGROUND

1. Field of the Invention

The present invention relates to stackable containers.

2. Background and Relevant Art

Many containers have been designed that are stackable or interlocking For example, many plastic food containers are designed so that the bottom of each container mates with the top or lid of each container to allow the containers to be stacked in an interlocked manner. Such designs facilitate the storage of the containers in minimal space on a shelf.

BRIEF SUMMARY

The present invention is directed to a stackable container system.

In one embodiment, the stackable container system of the present invention comprises a plurality of containers and a plurality of lids. The containers and lids are configured to allow any of the lids to be used on any of the containers. The bottom of each container is also configured to allow the container to be interlocked with the top of each lid.

In another embodiment, the stackable container system of the present invention comprises a plurality of containers, a plurality of lids, and a handle. The containers and lids are configured to allow any of the lids to be used on any of the containers. The bottom of each container is also configured to allow the container to be interlocked with the top of each lid. The handle is configured to attach to any of the lids to form a handle for carrying a stack of the interlocked containers.

In another embodiment, the stackable container system of the present invention comprises a plurality of containers and a plurality of lids. The containers and lids are configured to allow any of the lids to be used on any of the containers. The bottom of each container is also configured to allow the container to be interlocked with the top of each lid. The handle is configured to attach to any of the lids to form a handle for carrying a stack of the interlocked containers. At least one of the lids includes an opening, and the handle includes a sealing portion for sealing the opening in the lid when the handle is attached to the lid This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention is directed to a stackable container system.

In one embodiment, the stackable container system of the present invention comprises a plurality of containers and a plurality of lids. The containers and lids are configured to allow any of the lids to be used on any of the containers. The bottom of each container is also configured to allow the container to be interlocked with the top of each lid.

In another embodiment, the stackable container system of the present invention comprises a plurality of containers, a plurality of lids, and a handle. The containers and lids are configured to allow any of the lids to be used on any of the containers. The bottom of each container is also configured to allow the container to be interlocked with the top of each lid. The handle is configured to attach to any of the lids to form a handle for carrying a stack of the interlocked containers.

Figure 1:
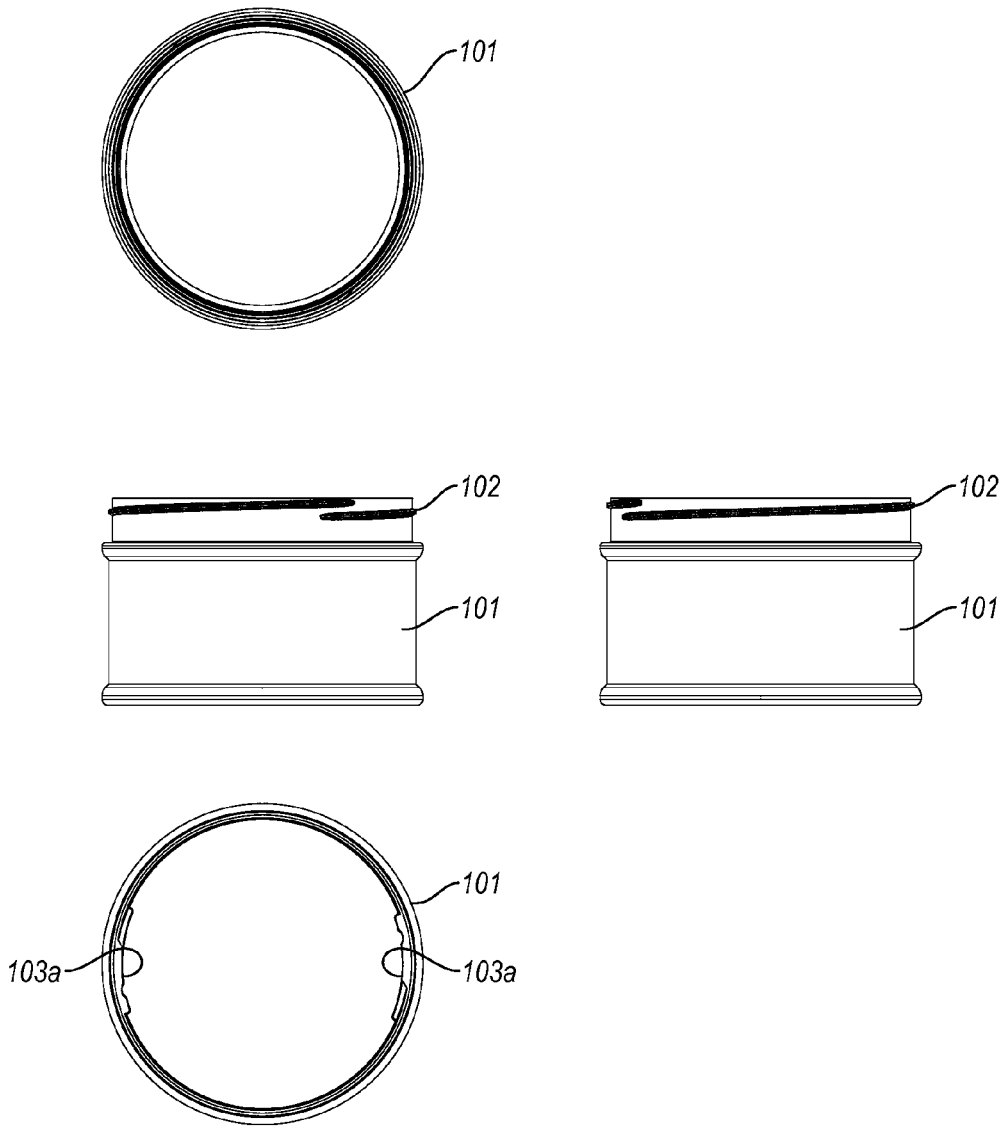
FIG. 1 illustrates various views of an exemplary container that can be used in the stackable container system of the present invention.
Figure 2:
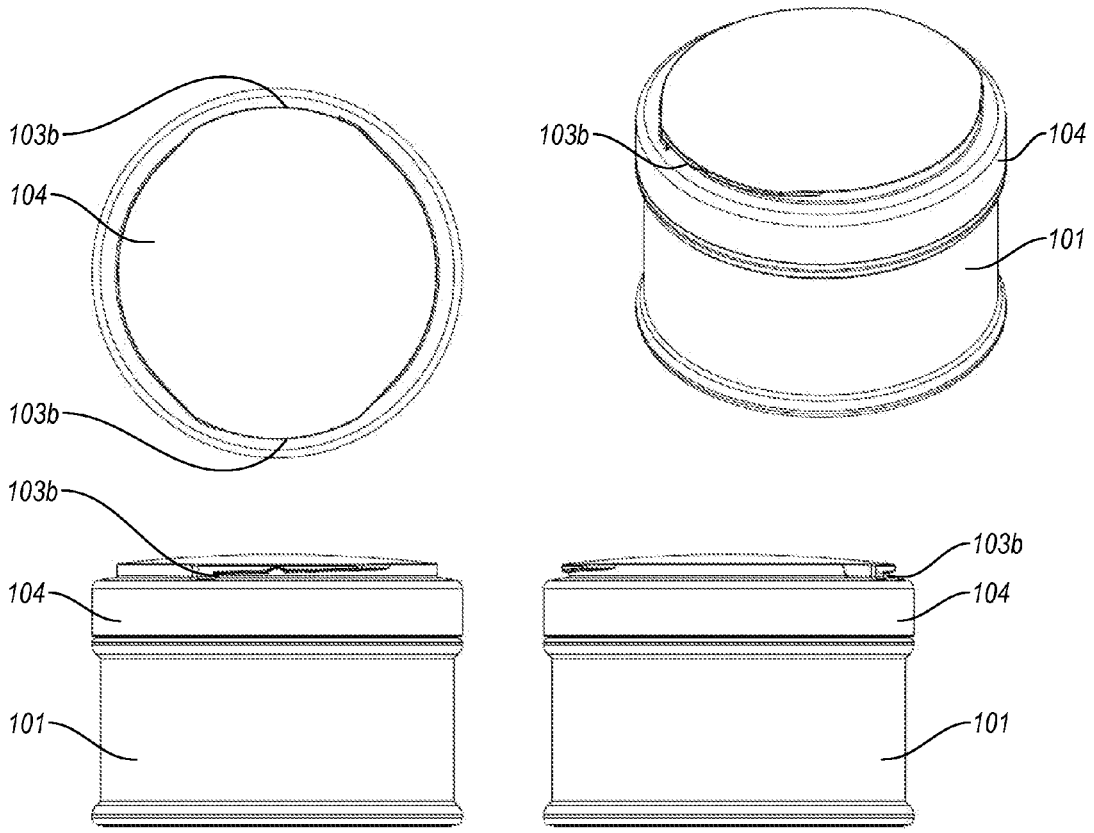
FIG. 2 illustrates various views of the exemplary container with a lid that can be used in the stackable container system of the present invention.

In another embodiment, the stackable container system of the present invention comprises a plurality of containers and a plurality of lids. The containers and lids are configured to allow any of the lids to be used on any of the containers. The bottom of each container is also configured to allow the container to be interlocked with the top of each lid. The handle is configured to attach to any of the lids to form a handle for carrying a stack of the interlocked containers. At least one of the lids includes an opening, and the handle includes a sealing portion for sealing the opening in the lid when the handle is attached to the lid FIG. 1 illustrates various views of an exemplary container 101, while FIG. 2 illustrates various views of exemplary container 101 with a lid 104 that can be used in the stackable container system of the present invention. As shown, container 101 includes threads 102 around the opening for screwing on a lid 104. Other means for attaching a lid 104 to a container 101 could equally be used as is known in the art.

In some embodiments of the invention, to interconnect containers, a container is attached to the lid of another container using a bayonet mount. For example, as shown in FIG. 1, the bottom of container 101 is configured with a male portion 103*a* of a bayonet mount that connects with a female portion 103*b* of the bayonet mount that is formed on the top of lid 104. Using the bayonet mount, a container 101 can be interconnected with a lid 104 thereby allowing multiple containers to be interconnected in a stack. Specifically, male portion 103*a* is twisted into female portion 103*b* where it is held in place within a pocket formed in female portion 103*b*.

Figure 3:
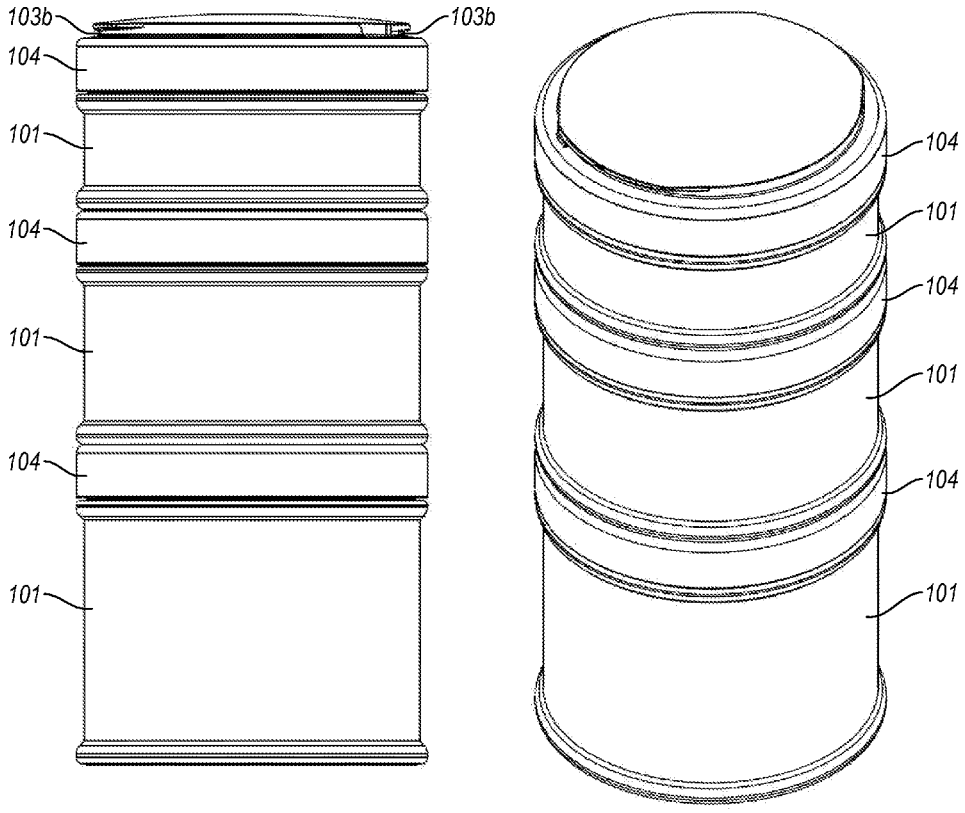
FIG. 3 illustrates various views of an exemplary stackable container system according to one or more embodiments of the present invention.

As shown in FIG. 3, the stackable container system of the present invention includes a plurality of containers 101 and a plurality of lids 104 that are each configured similarly to allow any of the containers 101 to be mounted to any of the lids 104 using the bayonet mount. As shown, each container 101 has been sealed by threading on a lid 104. Further, the top container 101 has been mounted to the lid 104 of the second container 101 by connecting male portion 103*a* of the top container 101 with female portion 103*b* of the lid 104 of the second container 101. The middle container 101 is mounted to the lid 104 of the bottom container 101 in the same manner.

Figure 4:
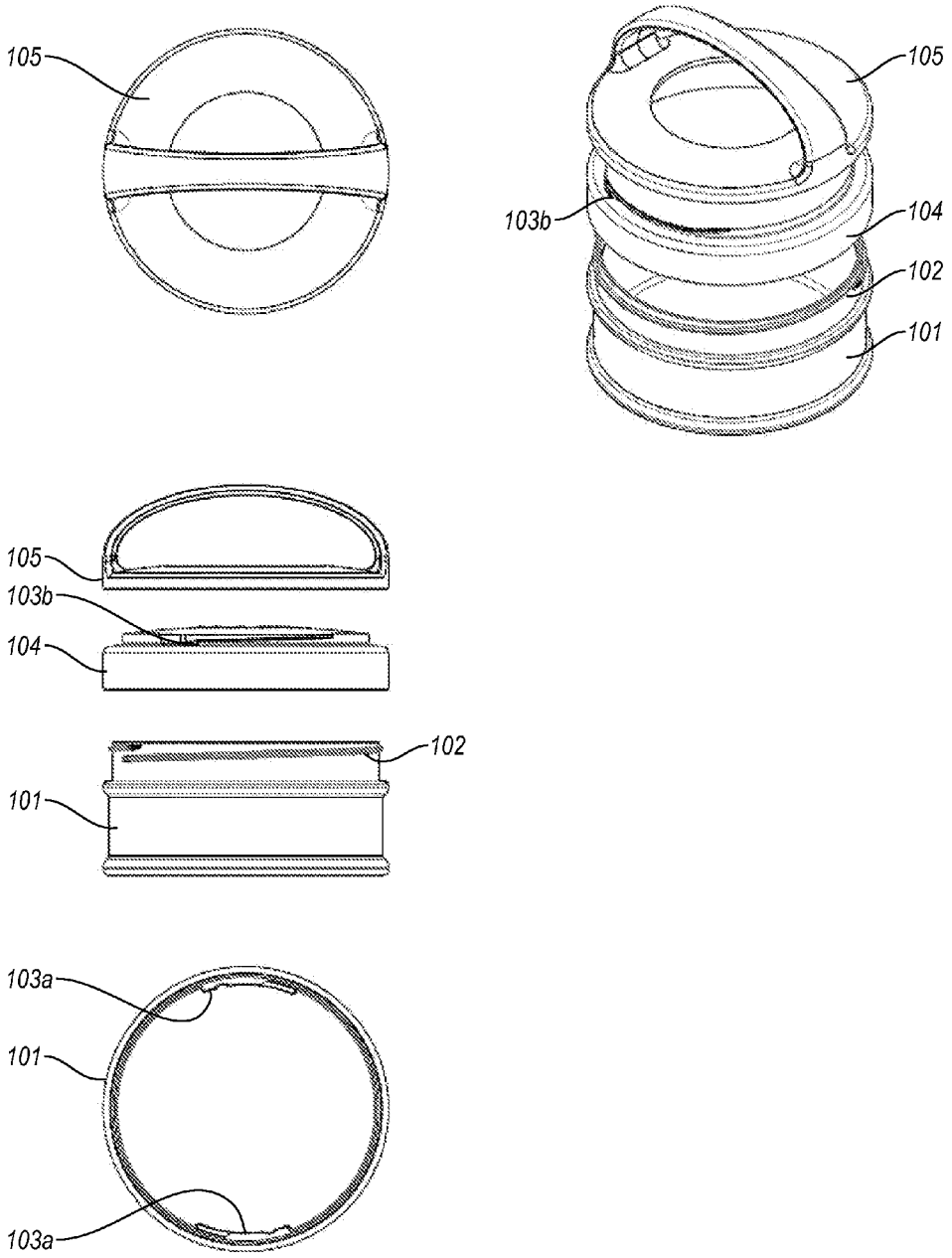
FIG. 4 illustrates various views of a handle that can be used in the stackable container system of the present invention.
Figure 5:
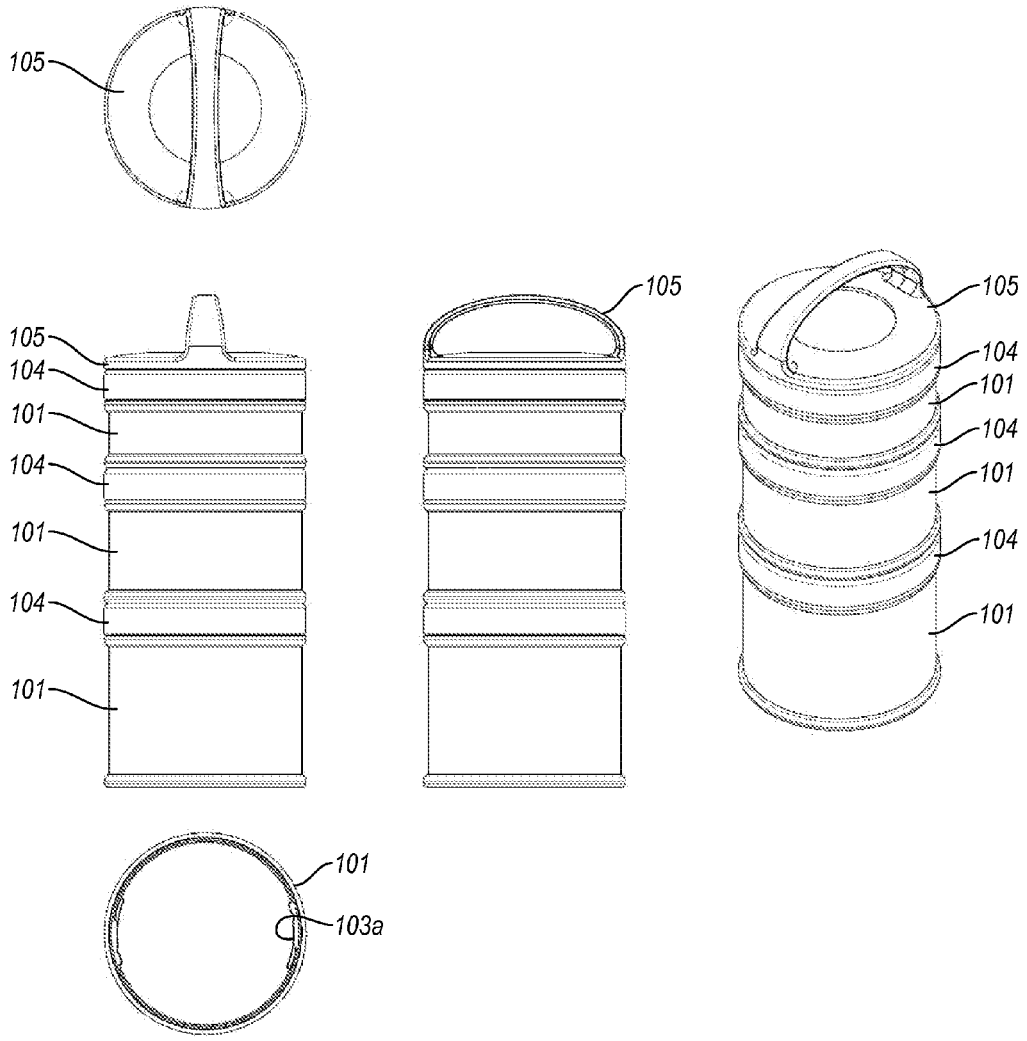
FIG. 5 illustrates various views of an exemplary stackable container system that includes a handle according to one or more embodiments of the invention.
Figure 6:
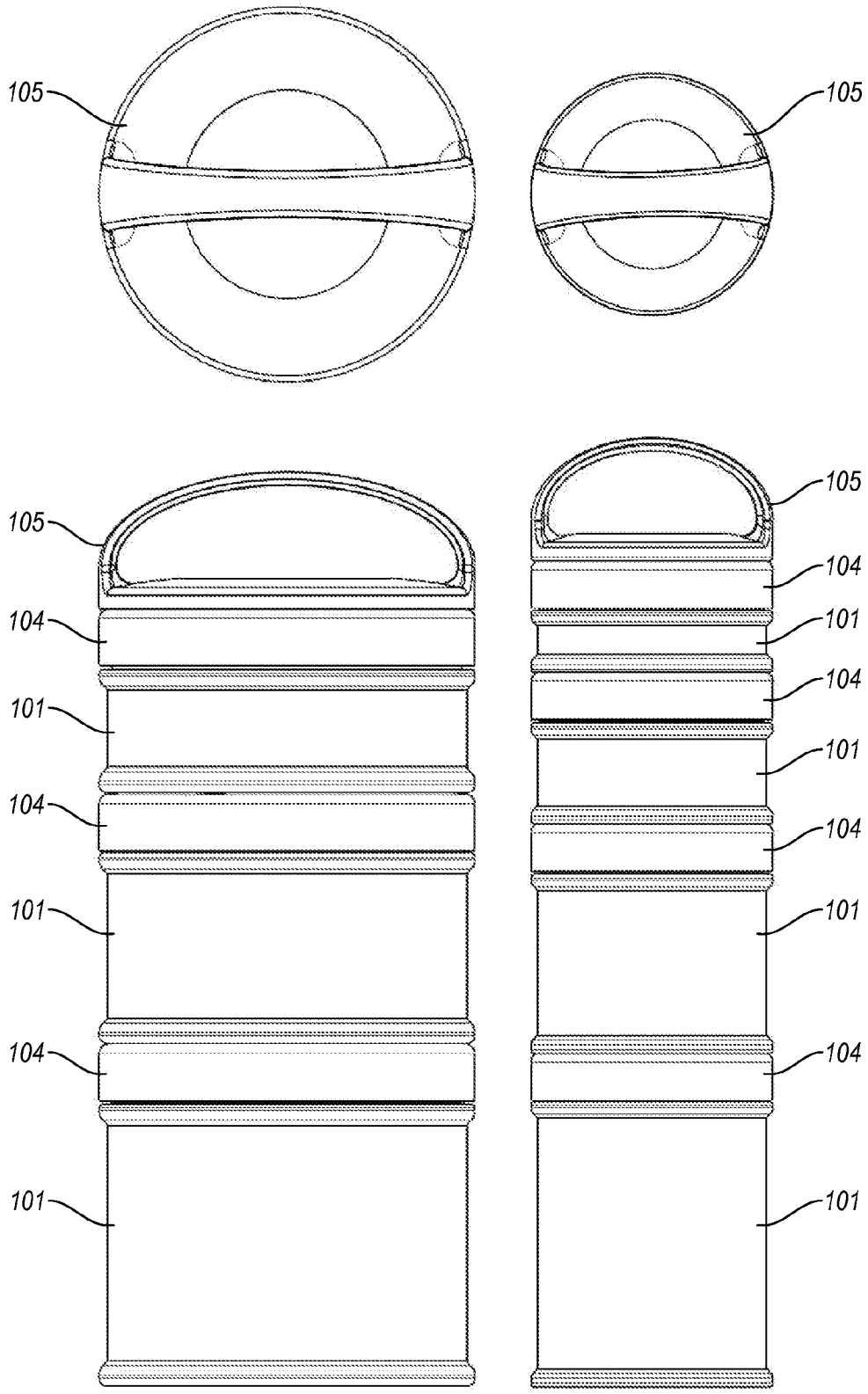
FIG. 6 illustrates exemplary stackable container systems of different sizes according to one or more embodiments of the invention.

As shown in FIG. 4, in some embodiments, the stackable container system can include a handle 105. The bottom of handle 105 (not shown) is also configured with a male portion 103*a* of a bayonet mount to enable handle 105 to be mounted to any of the lids. FIGS. 5 and 6 illustrate the stackable container system of FIG. 3 with the addition of handle 105. As can be seen, by mounting handle 105 to the stack of containers 101, the portability of the stack is increased. Further, because handle 105 can be mounted to any of the lids 104, the order in which the containers 101 are stacked is not important. Although a stack of three containers 101 is shown in FIG. 5, handle 105 can be attached to a stack of one or more containers 101 as desired. Also, as shown in FIG. 6, the stackable container system of the present invention can be of various sizes, and can be comprised of various numbers of containers 101 and lids 104.

Figure 7:
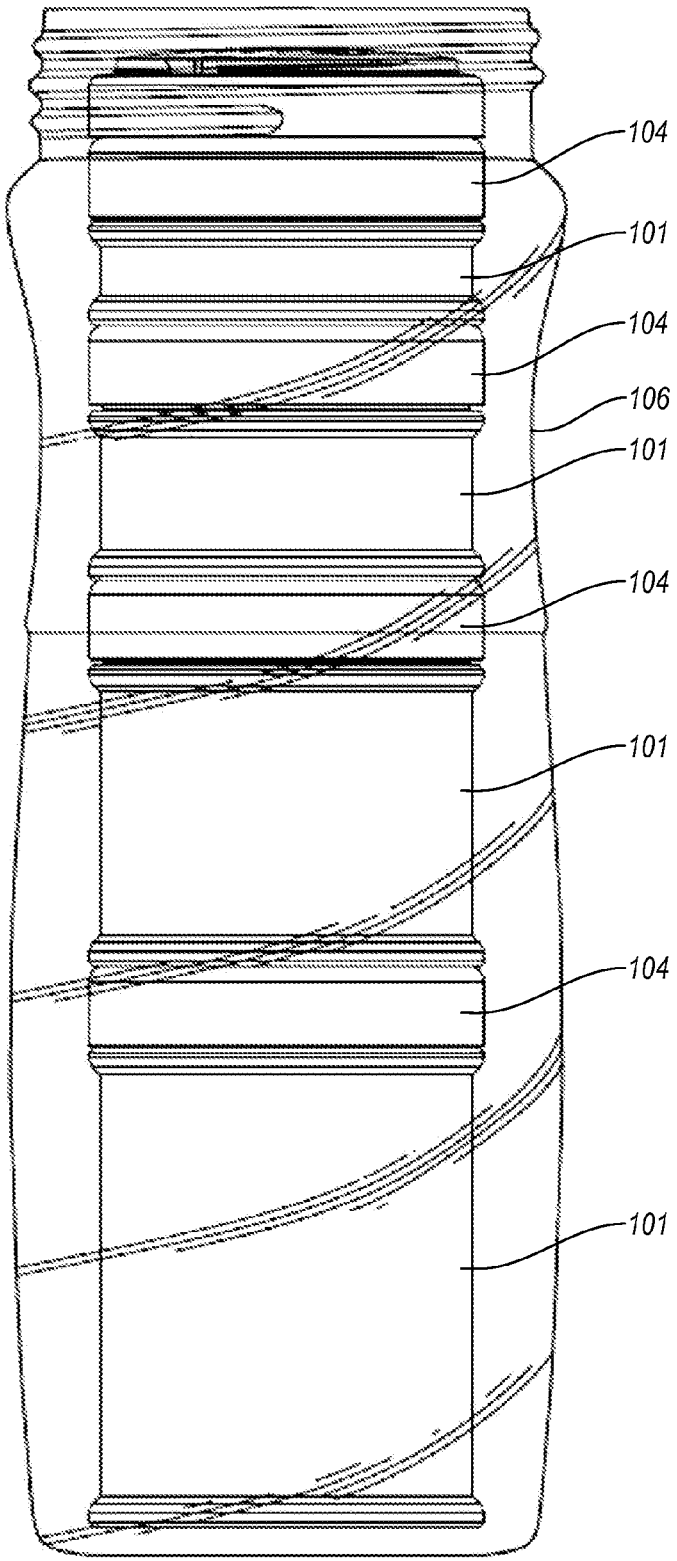
FIG. 7 illustrates an exemplary stackable container system including a storage container for containing a stack of interlocked containers according to one or more embodiments of the invention.

In some embodiments, a stackable container system can include a storage container for storing a stack of interlocked containers. FIG. 7, for example, illustrates an exemplary stackable container system where a beverage bottle 106 is used as the storage container. As shown, the containers 101 and lids 104 of the stackable container system are sized so that when interlocked, the stack fits within beverage bottle 106.

The stackable container system of the present invention provides various advantages. For example, a user can use the stackable container system to separately store, in containers 101, multiple ingredients that are to be later mixed together within beverage bottle 106 (e.g. with water or another liquid).

Alternatively, containers 101 can be used to separately store various ingredients for a meal (e.g. lettuce, croutons, and dressing for a salad) that can later be mixed (e.g. in one of containers 101).

In some cases, it may be desirable to keep certain contents of containers 101 cool or warm. To facilitate cooling or warming such contents, in some embodiments, lids 104 can be configured with a component that may be heated or cooled. In some embodiments, the component can be removable from the lid 104. In other embodiments, the entire lid 104 can be heated and cooled.

Lids 104 can also be configured with an insulated layer along the top of the lid that will minimize the amount of heat or cold that escapes upwardly into another container. In other words, lids 104 can be configured to retain as much heat or cold from the lid (or component of the lid) within the container to maximize the heating or cooling to the contents of the container. In such embodiments where lids 104 include an insulated layer, a lid 104 of one container 101 could be heated while a lid 104 of another container 101 could be cooled depending on the desired effect on the contents of the respective containers in a stack.

Figure 8:
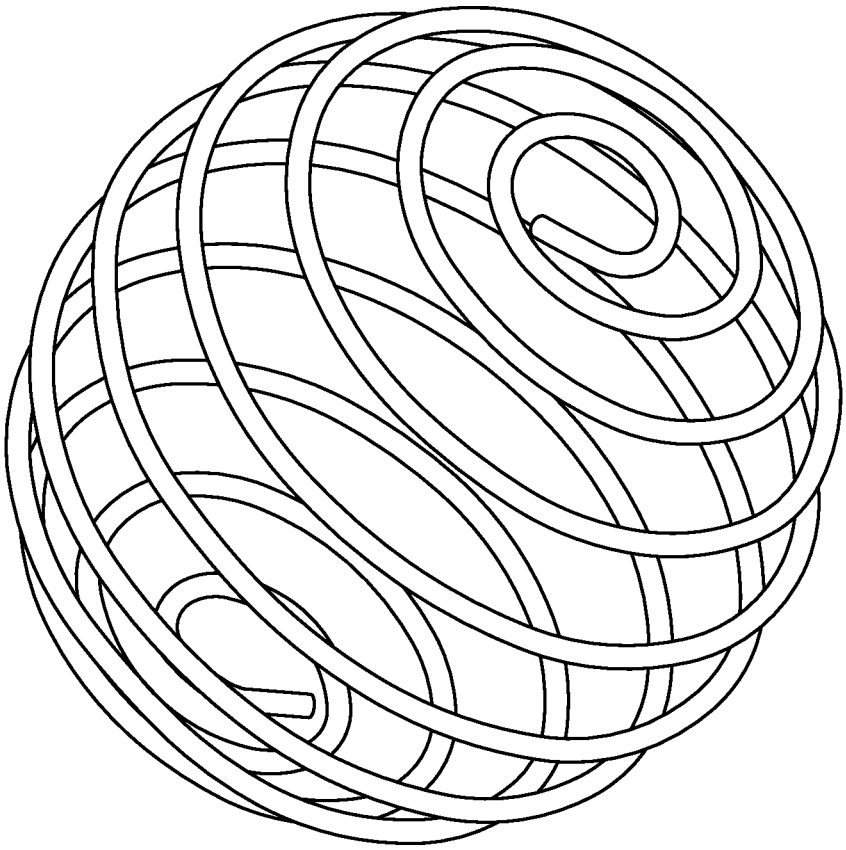
FIG. 8 illustrates an exemplary mixing whisk that can be stored inside the containers of the stackable container system of the present invention.

In some embodiments, as shown in FIG. 8, the stackable container system of the present invention can include a mixing whisk 107. Mixing whisk 107 can be compressible to allow it to be compressed and stored within any of containers 101.

Mixing whisk 107 can be used to facilitate the mixing of ingredients within a storage container such as beverage bottle 106. For example, mixing whisk 107 can be compressed and stored within one of containers 101 with the contents of the container. The containers 101 of the system can then be interlocked in a stack and stored within beverage bottle 106. At a later time, the containers 101 can be removed from beverage bottle 106, and their contents, including mixing whisk 107, can be added to beverage bottle 106. Water or another liquid can be added to beverage bottle 106 if necessary. Finally, beverage bottle 106 can be shaken to mix the contents. The presence of mixing whisk 107 in beverage bottle 106 facilitates the mixing of the contents within beverage bottle 106.

Figure 9:
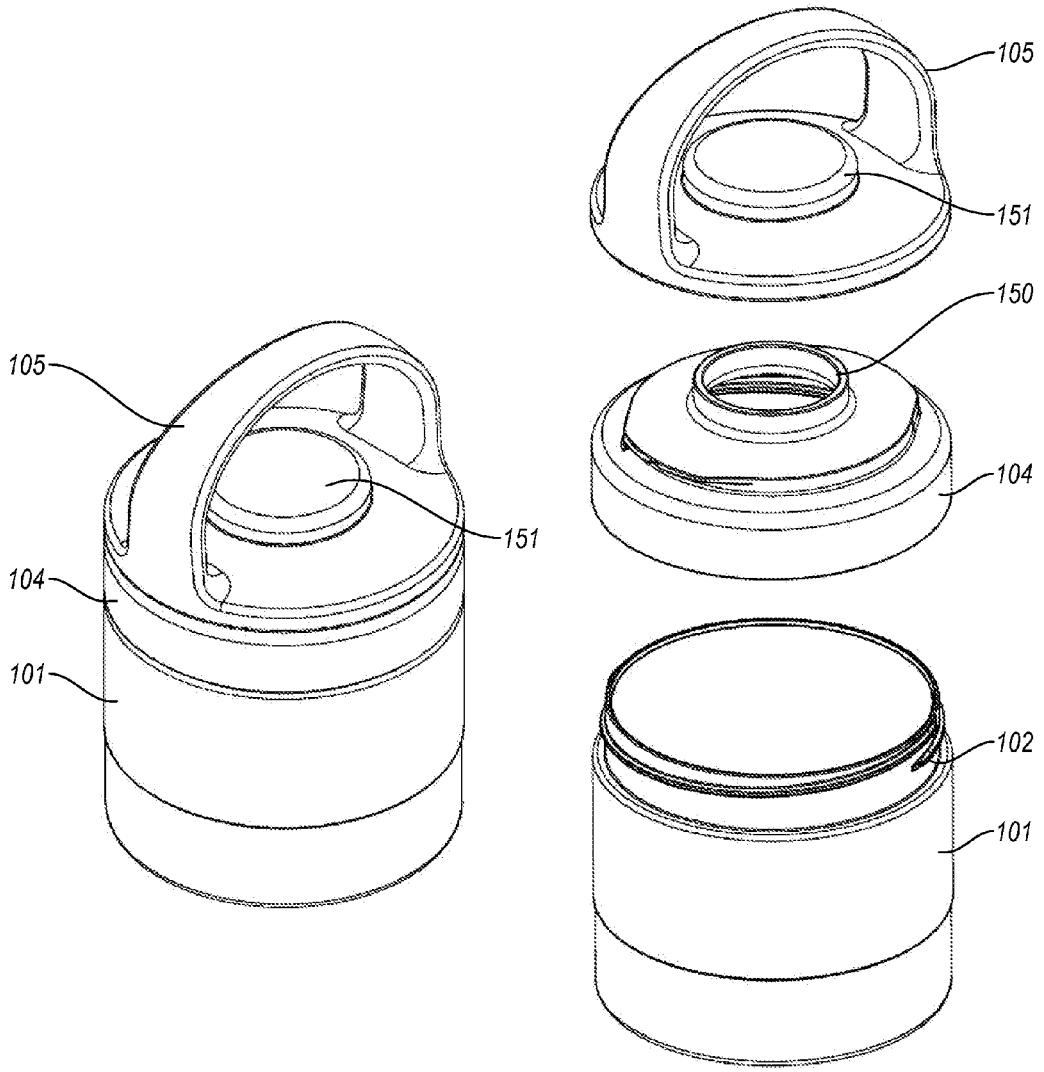
FIG. 9 illustrates various views of a lid that includes an opening, and a handle that includes a sealing portion to seal the opening in the lid according to one or more embodiments of the invention.

FIG. 9 illustrates another embodiment of a stackable container system in which at least one of the lids 104 includes an opening 150. Opening 150 can be generally circular as shown, or can be of other shapes and/or sizes. Opening 150 can facilitate the pouring of contents (e.g. powder contents such as baby formula, granular contents such as cereals, liquid contents such as salad dressing, etc.) from a container 101 without removing lid 104. In a particular embodiment, opening 150 can be sized to fit within an opening of a baby bottle to facilitate the pouring of baby formula from a container 101 into a baby bottle.

In such embodiments, handle 105 can be configured with a sealing portion 151 to secure opening 150 when the handle is attached to the lid 104. In some embodiments, a separate lid (rather than or in addition to a handle 105) can be included to secure opening 150. For example, a lid that is configured similar to handle 105, but without the handle portion, can be attached to lid 104. In some embodiments, the bottom of at least one of the containers 101 can also be configured to secure opening 150 when the container is attached to the top of the lid 104 having the opening 150.

Figure 10:
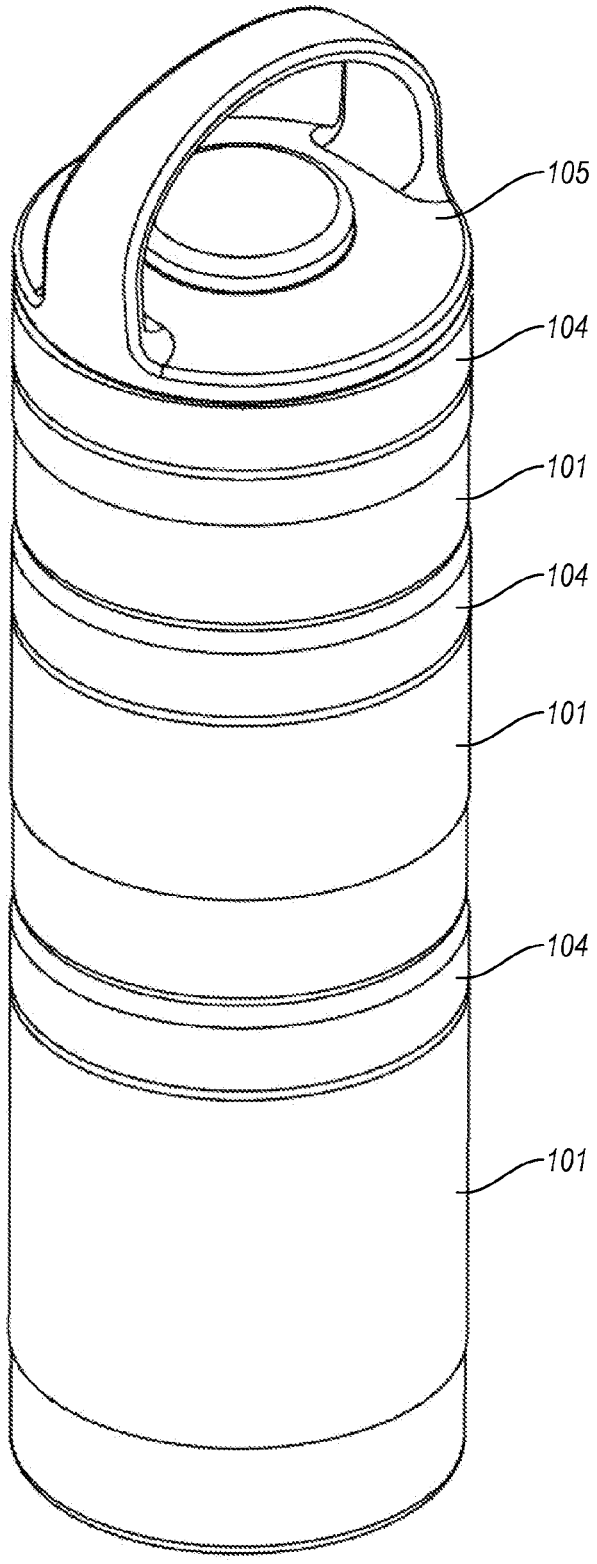
FIG. 10 illustrates an exemplary stackable container system including the lid and handle of FIG. 7.

For example, as shown in FIG. 10, a lid 104 having an opening 150 can be used on a container 101 in a stack. In some embodiments, where only the handle (or other lid or closure configured to be attached to lid 104) is configured with sealing portion 151, the lid 104 having the opening 150 can be used as the topmost container in the stack. However, in embodiments where at least one of the containers 101 is configured on the bottom with a sealing portion 151 (not shown), the lid 104 having the opening 150 can be used on a container 101 in a layer other than the topmost layer of the stack by securing the opening 150 by attaching a container 101 having a sealing portion 151 to the top of the lid 104. In this manner, more than one lid 104 having an opening 150 can be used within a single stack of containers.

In conclusion, embodiments of the present invention comprise a stackable container system in which multiple containers can be interlocked using lids. This interlocking can be achieved using a bayonet mount formed on the top of each lid and the bottom of each container to allow any lid to be used on any container. A handle may also be configured with a bayonet mount for connecting the handle to any of the lids.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A stackable container system comprising:

a plurality of containers including a top and a bottom, the top of each container of the plurality of containers comprising an upwardly extending circular flange and one or more threads on an outer surface of the upwardly extending circular flange, the bottom of each container of the plurality of containers comprising a downwardly extending circular flange and an inwardly extending mount on an inner surface of the downwardly extending circular flange;

a plurality of lids including a top and a bottom, the top of each lid of the plurality of lids comprising an upwardly extending portion with an outwardly extending flange and a receiving pocket, the bottom of each lid of the plurality of lids comprising a downwardly extending circular flange and one or more threads on an inner surface of the downwardly extending circular flange; and a handle comprising a downwardly extending circular flange and an inwardly extending mount on an inner surface of the downwardly extending circular flange;

wherein the containers and lids are sized and configured to allow any of the lids to be used on any of the containers, and the bottom of each container being configured to allow the container to be interlocked with the top of each lid, the threads on the outer surface of the upwardly extending circular flange on the top of the containers sized and configured to engage the threads on the threads on the inner surface of the downwardly extending circular flange on the bottom of the lids, the inwardly extending mount on the inner surface of the downwardly extending circular flange on the bottom of the containers sized and configured to engage the outwardly extending flange on the upwardly extending portion on the top of the lid; and wherein the handle is sized and configured to be selectively attached to any of the lids, the inwardly extending mount on the inner surface of the downwardly extending circular flange of the handle sized and configured to engage the outwardly extending flange on the upwardly extending portion on the top of the lid.

2. The stackable container system of claim 1, wherein the bottom of the containers and the top of the lids are configured with a bayonet mount for interlocking the containers and lids.

3. The stackable container system of claim 1, wherein at least one of the lids includes an opening and the handle includes a sealing portion for sealing the opening in the lid when the handle is attached to the lid.

4. The stackable container system of claim 3, wherein the bottom of at least one container is configured with a sealing portion for sealing the lid when the container is attached to the top of the lid.

5. The stackable container system of claim 1, wherein each lid comprises a component that may be heated or cooled to provide heating or cooling to the stack of interlocked containers.

6. The stackable container system of claim 5, wherein the component is removable from the lid.

7. The stackable container system of claim 1, further comprising:

one or more additional lids, each additional lid being capable of being heated or cooled to provide heating or cooling to the stack of interlocked containers.

8. The stackable container system of claim 1, wherein at least one of the lids includes an opening, the stackable container system further comprising an additional lid that includes a sealing portion for sealing the opening in the at least one lid when the additional lid is attached to the lid.

9. A stackable container system comprising:

a plurality of containers, each container of the plurality of containers including a top and a bottom;

a plurality of lids, each lid of the plurality of lids including a top and a bottom, the containers and the lids being configured to allow any of the lids to be used on any of the containers, and the bottom of each container being configured to allow the container to be interlocked with the top of each lid, the top of each lid comprising an upwardly extending portion with an outwardly extending flange and a receiving pocket; and a handle that is configured to attach to any of the lids to form a handle for carrying a stack of the interlocked containers, the handle comprising a downwardly extending circular flange and an inwardly extending mount on an inner surface of the downwardly extending circular flange, the inwardly extending mount on the inner surface of the downwardly extending circular flange of the handle sized and configured to engage the outwardly extending flange on the upwardly extending portion on the top of the lid to attach the handle to any of the lids.

10. The stackable container system of claim 9, wherein the bottom of the containers and the top of the lids are configured with a bayonet mount for interlocking the containers and lids.

11. The stackable container system of claim 9, wherein at least one of the lids includes an opening and the handle includes a sealing portion for sealing the opening in the lid when the handle is attached to the lid.

12. The stackable container system of claim 11, wherein the bottom of at least one container is configured with a sealing portion for sealing the lid when the container is attached to the top of the lid.

13. The stackable container system of claim 9, further comprising a storage container inside of which the stack of interlocked containers fits.

14. A stackable container system comprising:

a plurality of containers, each container of the plurality of containers including a top and a bottom, the top of each container comprising an upwardly extending circular flange and one or more threads on an outer surface of the upwardly extending circular flange, the bottom of each container comprising a downwardly extending circular flange and an inwardly extending mount on an inner surface of the downwardly extending circular flange;

a plurality of lids, each lid of the plurality of lids including a top and a bottom, the top of each lid comprising an upwardly extending portion with an outwardly extending flange and a receiving pocket, the bottom of each lid comprising a downwardly extending circular flange and one or more threads on an inner surface of the downwardly extending circular flange, the containers and lids being configured to allow any of the lids to be used on any of the containers, and the bottom of each container being configured to allow the container to be interlocked with the top of each lid; and a handle comprising a downwardly extending circular flange and an inwardly extending mount on an inner surface of the downwardly extending circular flange, the handle configured to be attached to any of the lids to form a handle for carrying a stack of the interlocked containers, the inwardly extending mount on the inner surface of the downwardly extending circular flange of the handle sized and configured to engage the outwardly extending flange on the upwardly extending portion on the top of the lid;

wherein at least one of the lids includes an opening, and the handle includes a sealing portion for sealing the opening in the lid when the handle is attached to the lid.

15. The stackable container system of claim 14, wherein the bottom of at least one container is configured with a sealing portion for sealing the lid that includes the opening when the container is attached to the top of the lid.

16. The stackable container system of claim 14, wherein the bottom of the containers and the top of the lids are configured with a bayonet mount for interlocking the containers and lids.

17. The stackable container system of claim 14, wherein at least one lid comprises a component that may be heated or cooled to provide heating or cooling to the stack of interlocked containers.

18. The stackable container system of claim 17, wherein the component is removable from the lid.

19. The stackable container system of claim 14, further comprising:

one or more additional lids, each additional lid being capable of being heated or cooled to provide heating or cooling to the stack of interlocked containers.

20. A stackable container system comprising:

a plurality of containers including a top and a bottom, the top of each container of the plurality of containers comprising an upwardly extending circular flange and one or more threads on an outer surface of the upwardly extending circular flange, the bottom of each container of the plurality of containers comprising a downwardly extending circular flange and an inwardly extending male portion of a bayonet mount on an inner surface of the downwardly extending circular flange; and a plurality of lids including a top, a bottom and an annular flange disposed between the top and the bottom, the top of each lid of the plurality of lids comprising an upwardly extending portion with an outwardly extending flange and a receiving pocket of a female portion of a bayonet mount, the top of each lid extending upwardly relative to the annular flange, the bottom of each lid of the plurality of lids comprising a downwardly extending circular flange and one or more threads on an inner surface of the downwardly extending circular flange, the bottom of each lid extending downwardly relative to the annular flange;

wherein the containers and lids are sized and configured to allow the bottom of any lid to be selectively connected to the top of any container by a threaded connection, and the bottom of each container to be selectively connected to the top of each lid by a bayonet connection, the threads on the outer surface of the upwardly extending circular flange on the top of the containers sized and configured to engage the threads on the threads on the inner surface of the downwardly extending circular flange on the bottom of the lids, the inwardly extending male portion of the bayonet mount on the inner surface of the downwardly extending circular flange on the bottom of the containers sized and configured to engage the outwardly extending flange of the female portion of the bayonet mount on the upwardly extending portion on the top of the lid.

* * * * *

UNITED STATES PATENT AND TRADEMARK OFFICE

CERTIFICATE OF CORRECTION

PATENT NO. : 9,120,598 B2
APPLICATION NO. : 13/609238
DATED : September 1, 2015
INVENTOR(S) : Meyers et al.

It is certified that error appears in the above-identified patent and that said Letters Patent is hereby corrected as shown below:

In the Specification

In Column 1, Line 13, delete "interlocking" and insert -- interlocking. --, therefor.

In Column 1, Line 46, delete "lid" and insert -- lid. --, therefor.

In Column 3, Line 2, delete "lid" and insert -- lid. --, therefor.

In the Claims

In Column 5, Line 47, in Claim 1, delete "threads on the threads" and insert -- threads --, therefor.

In Column 8, Line 31, in Claim 20, delete "threads on the threads" and insert -- threads --, therefor.

Signed and Sealed this
Twenty-eighth Day of June, 2016

Michelle K. Lee

Michelle K. Lee
*Director of the United States Patent and Trademark Office*